United States Patent [19]

Iijima

[11] Patent Number: 4,967,664

[45] Date of Patent: Nov. 6, 1990

[54] METHOD AND APPARATUS FOR AUTOMATICALLY CLEANING LIQUID SUPPLY ROLLERS OF OFFSET PRESS

[75] Inventor: Takashi Iijima, Yokosuka, Japan

[73] Assignee: Kabushiki Kaisha Tokyo Kikai Seisakusho, Tokyo, Japan

[21] Appl. No.: 404,217

[22] Filed: Sep. 7, 1989

[30] Foreign Application Priority Data

Dec. 6, 1988 [JP] Japan ..... 63-309693

[51] Int. Cl.[5] ..... B41F 35/00; B41L 41/00

[52] U.S. Cl. ..... 101/423; 101/425; 101/424

[58] Field of Search ..... 101/425, 424, 423, 422

[56] References Cited

U.S. PATENT DOCUMENTS

| | | | |
|---|---|---|---|
| 3,842,735 | 10/1974 | Southam et al. | 101/148 X |
| 4,311,095 | 6/1982 | Jeschke | 101/148 X |
| 4,353,299 | 10/1982 | Murai et al. | 101/148 X |
| 4,497,250 | 2/1985 | Dressler | 101/425 |
| 4,527,479 | 7/1985 | Dahlgren et al. | 101/148 X |
| 4,619,198 | 10/1986 | Moll | 101/148 |
| 4,690,055 | 9/1987 | Fadner et al. | 101/148 X |
| 4,760,857 | 8/1988 | Shiba et al. | 101/425 X |

FOREIGN PATENT DOCUMENTS

| | | | |
|---|---|---|---|
| 61-22950 | 1/1986 | Japan | 101/423 |

*Primary Examiner*—Edgar S. Burr
*Assistant Examiner*—Motilal P. Patel
*Attorney, Agent, or Firm*—R. A. Giangiorgi

[57] ABSTRACT

Method and apparatus capable of automatically cleaning a dampening water supply passage to a plate cylinder in an offset press, as well as an ink supply passage to the late cylinder. The apparatus comprises an operation instruction means producing operation signals in a sequence to driving portions of various means which include ink supply-stopping means, means for supplying a cleaning solvent, cleaning waste recovering means, means for bringing ink supply rollers out of contact with the plate cylinder, means for bringing dampening water supply rollers out of contact with the plate cylinder, and main control means, a start instruction means that starts the operation instruction means, and a manual instruction means. This manual instruction means permits the operator to select either cleaning of only the ink supply passage or cleaning of all the ink supply passage and the dampening water supply passage.

2 Claims, 5 Drawing Sheets

METHOD AND APPARATUS FOR AUTOMATICALLY CLEANING LIQUID SUPPLY ROLLERS OF OFFSET PRESS

FIELD OF THE INVENTION

The present invention relates to a method and an apparatus for automatically cleaning ink supply passages and dampening water supply passages through which liquids needed for offset printing, or ink and dampening water, are supplied onto press plates placed on plate cylinders. More particularly, the invention relates to automated cleaning of dampening water supply passages, which has been heretofore impossible to realize.

BACKGROUND OF THE INVENTION

When an offset press is operated to print, foreign matter such as dust and paper dust tends to adhere to the rollers of the ink supply system. If so, the printed characters or images become blurred or parts of them fail to be printed. As a result, the print quality deteriorates. Accordingly, it is necessary to clean the outer peripheries of the rollers forming an ink supply passage whenever such a defect is found or at regular intervals of time.

The conventional method of cleaning the outer peripheries of the rollers forming an ink supply passage generally involves the following steps.

(1) First, the operation of either the ink supply roller or the ink pump is stopped to cut off the supply of ink.

(2) Then, the cylinders are disengaged from each other, and the inking rollers are moved off the press plates on the plate cylinders.

(3) A scraping doctor blade equipped with a waste liquid recovery tray is pressed against each cylinder.

(4) Each cylinder is rotated while supplying a cleaning solvent into a given portion located in an ink supply passage.

(5) Ink loosened by the solvent, dust and paper dust contained in the ink, and other foreign matter are scraped off by the doctor blade to discharge them into the water liquid recovery portion (see "Newspaper Printing, revised edition", Japan Newspaper Association Corporation, Oct. 31, 1980; left column, line 3–15, p. 209; from line 28 of the left column to line 4 of the right column, page 251. Also see "Offset Press", Japan Printing Newspaper Company, Jun. 25, 1984, lines 10–18, p. 108.)

It is also Known that the aforementioned series of cleaning steps is automated by a sequential control means (see Japanese Patent Publication Nos. 6066/1980 and 24218/1982, Japanese Patent Laid-Open No. 151343/1987.)

When the printing operation ends or the ink color is exchanged, it is necessary to clean the outer peripheries of rollers forming a dampening water supply passage, in addition to the cleaning of the outer peripheries of the rollers forming an ink supply passage. This is done to prevent ink color mixing and to avoid water repellency which would normally be caused by sensitization of a dampening water supply passage.

The prior art method of cleaning the outer peripheries of rollers forming a dampening water supply passage comprises the following steps.

(1) The dampening water application roller is removed from the offset press whenever a given number of sheets are printed or at regular intervals of time.

(2) This roller is cleaned with a known roller cleaner or manually (see the aforementioned "Newspaper Printing, revised edition", lines 19–29, p. 217.)

As described above, the cleaning of an ink supply passage has been already automated, but the cleaning of a dampening water supply passage has relied solely on a worker's manual operation. Further, as the water application rollers are mounted and detached, long time and much labor are needed. Sometimes, the removal and attachment of the rollers are omitted, and the work is done at the mounting position.

Since a dampening water supply passage is frequently mounted at a deep position in a complex portion inside an offset press, the worker is urged to perform a cleaning and wiping operation in a cramped or dangerous posture. In addition, the waste liquid produced by the cleaning flows out, thus fouling the worker's clothes. In this way, the working conditions are inferior. Therefore, the worker becomes physically and mentally unpleasant. Hence, it is highly likely that the working efficiency is low.

Accordingly, when the ink color is changed or the printing operation is complete, the cleaning of the dampening water supply passage tends to be treated lightly and omitted unless the print quality deteriorates too much. If such an omission is repeated, the sensitization of the rollers is promoted. This shortens their life.

SUMMARY OF THE INVENTION

It is an object of the invention to provide a method and an apparatus which automatically clean liquid supply rollers of an offset press, are capable of automatically cleaning not only the ink supply passage but also the dampening water supply passages, permit high working efficiency, print at high quality at all times, and enable one to easily maintain the dampening water supply passages.

The above object is achieved in accordance with the teachings of invention by an apparatus for automatically cleaning the liquid supply rollers of an offset press having ink supply-stopping means, means for supplying a cleaning solvent into the ink passages at given locations, cleaning waste recovery means mounted at given locations in the ink supply passages, means for bringing ink supply rollers adjacent to the plate cylinders into and out of contact with the plate cylinders, means for bringing dampening water supply rollers adjacent to the plate cylinders into and out of contact with the plate cylinders, and a main control means controlling the operation of the offset press. The apparatus comprises: an operation instruction means which produces operation signals in a given sequence to the driving portions of said various means; a start instruction means that starts the operation instruction means; and a manual instruction means which permits one to instruct the operation instruction means to clean only the ink supply passages or all of the ink supply passages and the dampening water supply passages.

The above object is also achieved by a method of automatically cleaning the liquid supply rollers of an offset press, said method consisting in specifying either cleaning of an ink supply passage cleaning process and a dampening water supply passage cleaning process or cleaning of only the ink supply passage cleaning process. The ink supply passage cleaning process involves stopping the supply of ink, moving at least ink supply rollers adjacent to plate cylinders away from the plate cylinders, and supplying a cleaning solvent into given portions in the ink supply passages to clean the passages. The dampening water supply passage cleaning process involves pressing those ink supply rollers and dampening water supply rollers which are adjacent to the plate cylinders against the plate cylinders, supplying the cleaning solvent into the dampening water supply passages from the ink supply passages via the press plates upon the plate cylinders, and recovering wastes from the ink supply passages via the press plates upon the plate cylinders. The wastes arise from cleaning of the dampening water supply passages.

The operator operates the manual instruction means to specify either cleaning of only the ink supply passages for preventing the printing quality from deteriorating during printing operation or successive cleaning steps for the ink supply passages and the dampening water supply passages at the time when the ink color is changed or the printing operation is completed. Then, the start instruction means is operated to send a start signal to the operation instruction means.

When the operation instruction means receives the start signal from the start instruction means, the operation instruction means delivers operation signals to the driving portions of ink supply-stopping means, cleaning solvent supply means, waste liquid recovery means, means for bringing certain rollers located in the ink supply passages into and out of contact with the plate cylinders, means for bringing certain rollers located in the ink supply passages into and out of contact with the plate cylinders, and means for bringing given rollers mounted in the dampening water suppy passages into and out of contact with the plate cylinders, according to the instructions issued by the manual instruction means and in the predetermined order for each instruction.

In response to the operation signals, the driving portions are caused to operate in a given sequence, for performing a specified cleaning operation either during the printing operation or at the end of the printing operation.

The ink supply passages are cleaned irrespective of the kind of cleaning. The cleaning is done after stopping the supply of ink and moving the ink supply rollers adjacent to the plate cylinders away from the cylinders.

The cleaning of the dampening water supply passages is done subsequent to the cleaning of the ink supply passages only after the end of a printing process. This method involves pressing those rollers against the plate cylinders via press plates which are adjacent to the cylinders and used to supply ink and dampening water, respectively, supplying a cleaning solvent into the dampening water supply passages from the ink supply passages via the press plates to clean the dampening water passages and sending the waste liquid produced in the dampening water supply passages into the ink supply passages via the press plates to recover the liquid.

Other objects and features of the invention will appear in the course of the description thereof which follows.

BREIF DESCRIPTION OF THE DRAWINGS

DETAILED DESCRIPTION OF THE INVENTION

Figure 1:
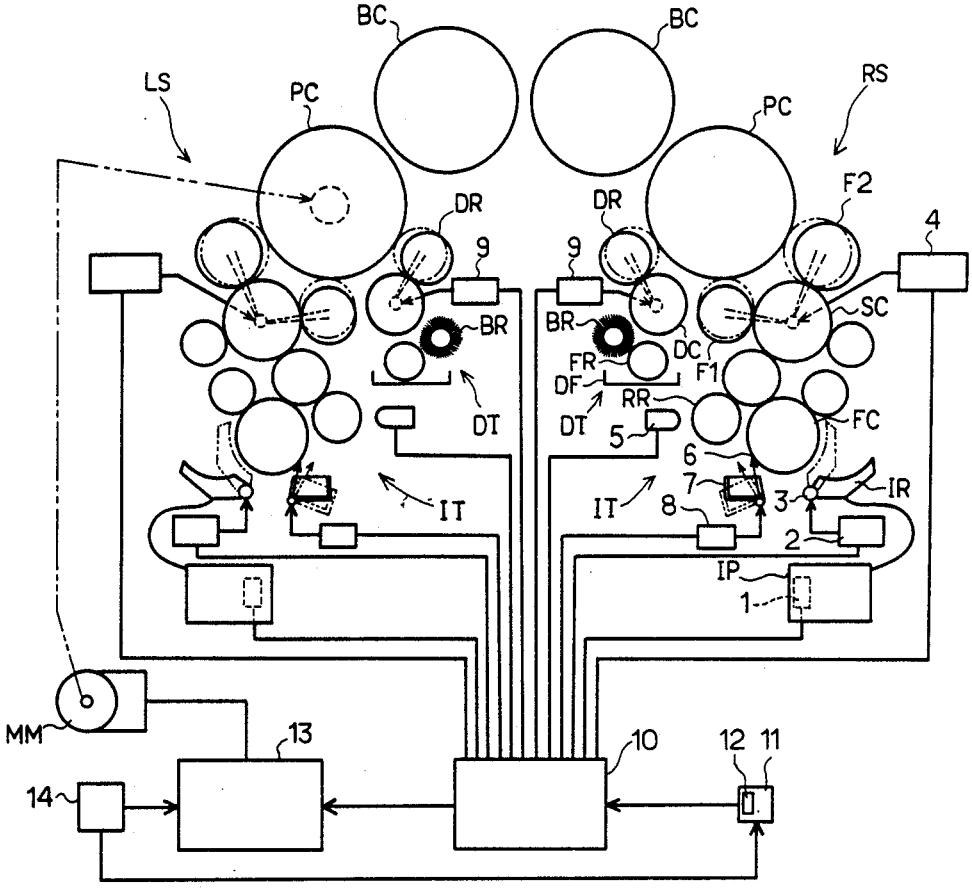
FIG. 1 is a schematic of an offset press equipped with an automatic cleaning apparatus according to the invention.

Referring to FIG. 1, there is shown an offset press embodying the concept of the invention. This press comprises a left blanket cylinder BC, a right blanket cylinder BC, plate cylinders PC cooperating with the blanket cylinders BC, respectively, ink supply passages IT for supplying ink to the plate cylinders, and dampening water supply passages DT for supplying dampening water to the plate cylinders. The blanket cylinders BC make and break contact with each other.

Each ink supply passage IT comprises a set of rollers. Specifically, the passage IT consists of an ink source, for example an ink pump IP, an ink rail IR connected with the pump IP, a first ink cylinder FC opposite to the rail IR, inking rollers F1 and F2 adjacent to a plate (not shown) on the plate cylinder PC. The first ink cylinder FC is located on the most upstream side. The inking rollers F1 and F2 are disposed on the most downstream side.

Each dampening water supply passage DT is comprised of a set of rollers. In particular, the supply passage DT comprises a dampening water source, such as a dampening water fountain DF, a fountain roller FR partially immersed in the dampening water, a brush roller BR located on the most upstream side, and a dampening water application roller DR adjacent to the press plate (not shown) on the plate cylinder PC. The application roller DR is located on the most downstream side. The brush roller BR is in contact with the fountain roller FR and rotates with it.

The details of the aforementioned ink supply passage IT are now described. The pump IP-has a driving shaft (not shown) equipped with a clutch 1. When this clutch is engaged, supply of ink to the rail IR is allowed. When the clutch is disengaged, the supply is stopped. The ink rail IT is so mounted as to be angularly movable about a pivot 3 by an opening and closing driver 2 such as a fluid pressure cylinder and by a portion transmitting the driving power, such as an arm link (not shown). The inking rollers F1 and F2 are mounted by a driver 4, such as a fluid pressure cylinder, and a portion transmitting the driving power, such as an arm or link (not shown) in such a way that it can rock about the shaft of the second ink cylinder SC. The rocking action permits the rollers F1 and F2 to make and break contact with the press plate (not shown) on the plate cylinder PC.

The solvent supply means 5 for cleaning comprises supply nozzles (not shown) juxtaposed longitudinally of a roller RR at a suitable location in the ink supply passage IT. A waste liquid recovery means consist of a doctor blade 6 and a rotatable conduit 7 attached to the blade. The doctor blade 6 is driven by a rotating driver 8, such as a fluid pressure cylinder, and by a portion transmitting driving power, such as an arm ring (not shown), so as to make and break contact with the outer periphery of the first ink cylinder FC. In the illustrated example, the conduit 7 is integral with the doctor blade 6. It is also possible to separate them vertically. The recovery conduit 7 may be equipped with an automatic discharge means to discharge wastes arising from cleaning into the outside.

The dampening water application roller DR is mounted so as to be swingable about the shaft of a dampening water cylinder DC by a driver 9, such as a fluid pressure cylinder, and by a portion transmitting driving power, such as an arm or link (not shown). Thus, the roller can make and break contact with the press plate (not shown) on the plate cylinder PC.

The clutch 1 for permitting and stopping supply of ink to the ink pump IP, the opening and closing driver 2 of the ink rail IR, the driver 4 for bringing the inking rollers F1 and F2 into and out of contact with the plate cylinder PC, the cleaning solvent supply means 5, the driver 8 for rotating the doctor blade 6, and the driver 9 for bringing the dampening water roller DR into and out of contact with the plate cylinder PC are each equipped with an operation switching portion (not shown) such as a fluid pressure switching valve. The body of each of these components is connected with its operation switching portion. All of the operation switching portions are connected to an operation instruction means 10, which is connected with a main controller 13 and also with a start instruction means 11. The main controller 13 is connected with an offset press running means 14, which is, in turn, connected with the start instruction means 11 including a manual instruction means 12. This manual instruction means 12 can also be mounted independent of the instruction means 11.

The rollers are automatically cleaned at the end of a printing process or at the time when the ink color is changed. The rollers can also automatically cleaned during the printing process. These two kinds of cleaning are next described separately.

(A) Automatic Cleaning of Rollers when Printing is Completed or when the Ink Color is Changed (1) The operator makes a check to see if the main power switch (not shown) is ON.

(2) Then, the operator makes a check to see if the blanket cylinders BC have been moved away from their respective cooperating plate cylinders PC, if the inking rollers F1 and F2 adjacent to the plate cylinder PC have been moved away from the cylinder PC, and if the dampening water roller DR has been moved away from the cylinder PC.

Figure 2:
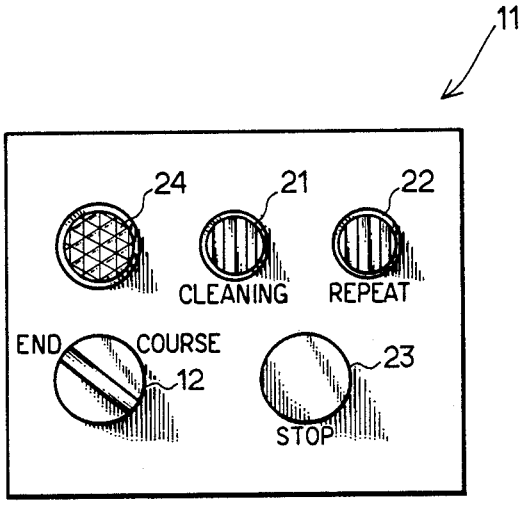
FIG. 2 is an enlarged front elevation of the start instruction means 11 shown in the right lower part of FIG. 1.

(3) An operation switch (not shown) on the offset press running means 14 is depressed to switch the operation of the offset press into a low-speed operation mode via then main controller 13. The depression of the switch also turns on the start instruction means 11 and the manual instruction means 12, such as a selector switch. As an example, an input lamp 24 (FIG. 2) is lit up.

(4) The operator then operates the switch on the manual instruction means 12 to select "print end". Subsequently, a cleaning switch 21 on the start instruction means 11 is depressed to send an operation start signal to the operation instruction means 10. Preferably, the cleaning switch 21 and a repeat switch 22 (described later) are lit up when they are closed.

Figure 3:
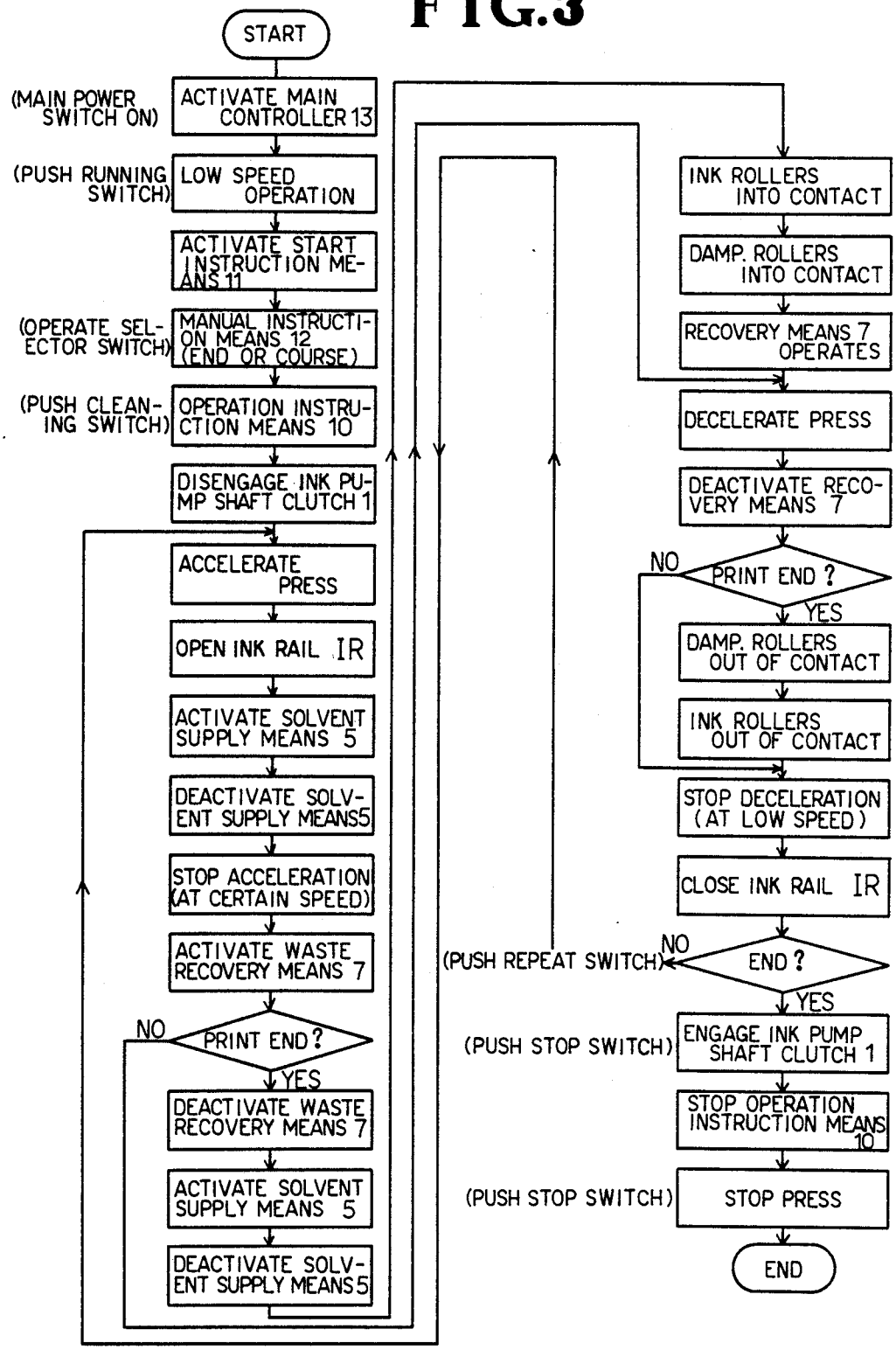
FIG. 3 is a flowchart illustrating a series of operations performed by the apparatus shown in FIG. 1.
Figure 4:
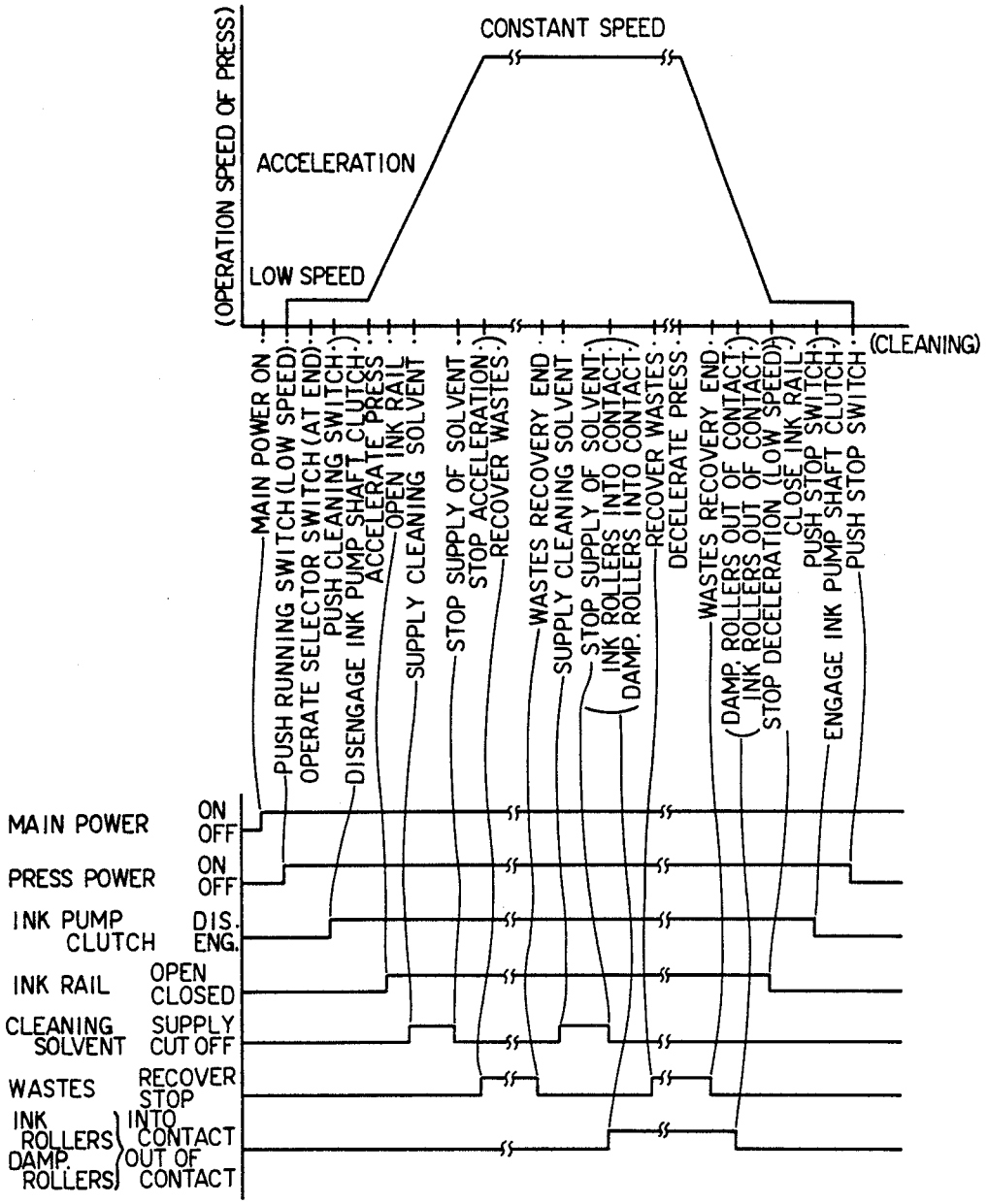
FIG. 4 is a time chart illustrating the cleaning done when a printing operation is completed or when the ink color is changed according to the flowchart of FIG. 3.
Figure 5:
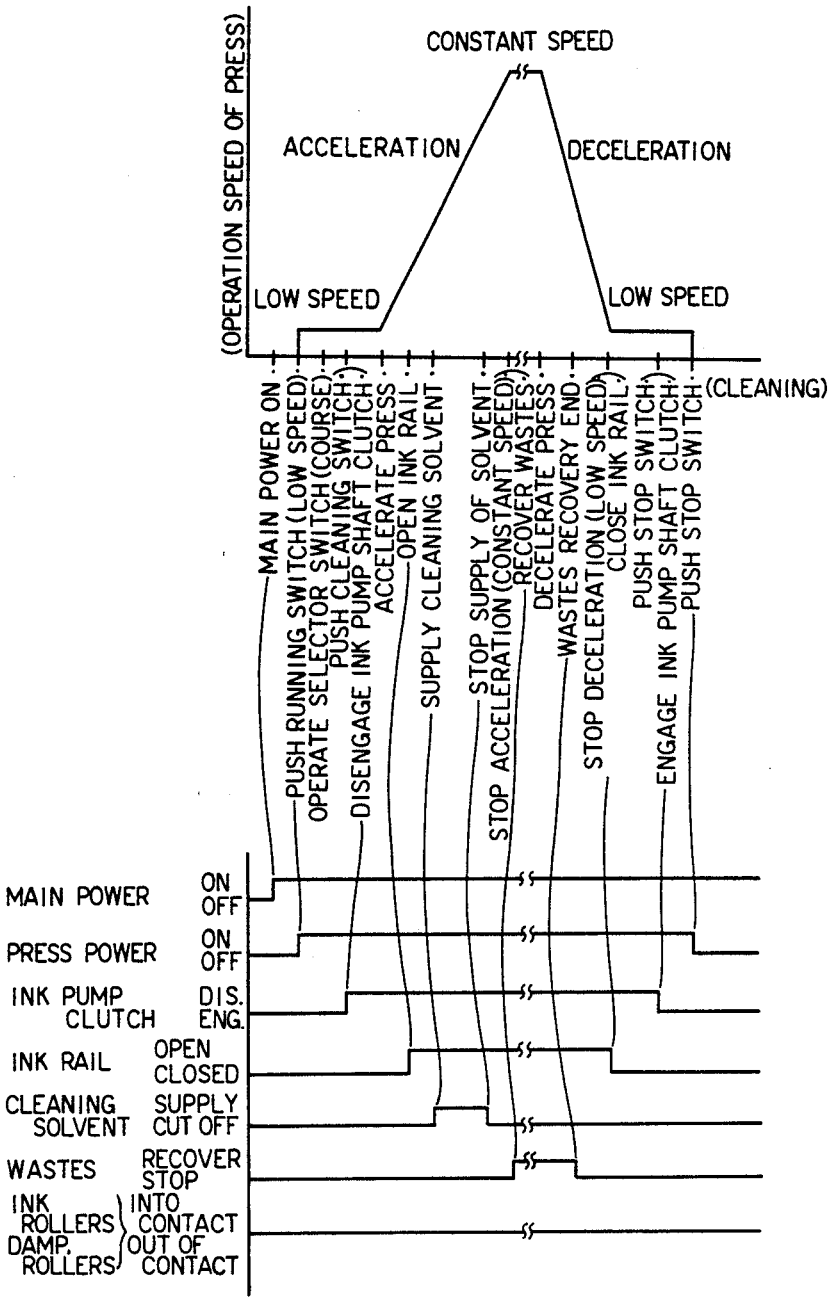
FIG. 5 is a time chart illustrating the cleaning done during a printing operation according to the flowchart of FIG. 3.

(5) When the operation instruction means 10 receives the instruction from the manual instruction means 12 and the operation start signal from the start instruction means 11, the instruction means 10 issues a series of instruction signals successively as illustrated in FIG. 3 to automatically clean the rollers under sequential control, as described in greater detail below.

(a) The clutch 1 of the driving shift of the ink pump is disengaged to stop the operation of the ink pump IP, for stopping the supply of ink.

(b) The working velocity of the offset press is gradually increased via the main controller 13.

(c) The driver 2 is opened to release the ink rail IR, i.e., the position indicated by the solid line in FIG. 1 is assumed.

(d) The cleaning solvent supply means 5 is operated for a given period to supply a cleaning solvent.

(e) The acceleration of the offset press which reached a given speed during the given period in the step (d) is stopped under the control of the main controller 13. The operation is continued at the given speed. Also, rotating driver 8 is operated to press the doctor blade 6 mounted on the rotating conduit 7 against the outer periphery of the first ink cylinder FC, i.e., the position indicated by the solid line in FIG. 1 is assumed. The wastes arising from the cleaning and containing the remaining ink, for example, is forced into the conduit 7 by the doctor blade 6 to recover the wastes.

(f) After a lapse of a given time sufficient for recovery of the wastes, the rotating driver 8 is driven in a direction opposite to the direction taken in the step (e) to move the doctor blade 6 away from the outer periphery of the first ink cylinder FC to the position indicated by the phantom line in FIG. 1. Thus, the recovery operation is finished.

(g) The cleaning solvent supply means 5 is again operated for a given time to supply the cleaning solvent.

(h) The driver 4 for moving the inking rollers and the driver 9 for moving the dampening water application roller are so driven that the inking rollers F1, F2 and the dampening water application roller DR may bear against the press plates (not shown) on the plate cylinders PC, i.e., the positions indicated by the phantom lines in FIG. 1 are assumed. The cleaning solvent supplied to the ink supply passage IT is forced into the dampening water supply passage DT via the press plate to clean the passage.

(i) The rotating driver 8 is again driven in the same direction as in the step (e) to force the wastes into the rotating conduit 7 by the action of the doctor blade 6. The wastes are obtained by cleaning the dampening water supply passage DT and contains the ink component or the like entering the dampening water supply passage.

(j) The working velocity of the offset press is gradually reduced under the control of the main controller 13.

(k) The rotating driver 8 is again driven in a direction opposite to the direction taken in the step (e) to complete the recovery of the wastes.

(l) The driver 9 for moving the dampening water application roller and the driver 4 for moving the inking rollers are driven in directions opposite to the directions taken in step (h), to move the dampening water application roller DR and the inking rollers F1, F2 away from the press plates (not shown) on the plate cylinders PC into the positions indicated by the solid lines in FIG. 1.

(m) When the offset press arrives at the initial speed, the deceleration is stopped by the main controller 13. The operation is then continued at the initial speed. Also, the opening and closing driver 2 is driven in a direction opposite to the direction taken in step (c) to close the ink rail IR as indicated by ther phantom line in FIG. 1.

In this automatic cleaning process, parts of the steps (d) and (e) may be carried out simultaneously. Also, parts of the steps (g), (h), (i) may be performed at the same time.

(6) If the worker is not satisfactory for the results of the automatic cleaning that is done under sequential control as described thus far, then he can depress the repeat switch 22 on the start instruction means 11 to repeat the steps (b)-(m) under the control of the operation instruction means 10.

(7) If the results of the automatic cleaning are satisfactory, then the worker depresses a stop switch 23 on the start instruction means 11 to finish the automatic cleaning. The depression of the stop switch 23 engages the clutch 1 of the driving shaft of the ink pump.

(8) After the completion of the automatic cleaning, a stop switch (not shown) on the offset press running means 14 is depressed to stop the offset press. Then, the start instruction means 11 and the manual instruction means 12 are turned off. As a result, the input light 24 goes off.

(9) A check is made to see if all the other operations are completed. Then, the main power switch (not shown) is turned off.

(B) Automatic Cleaning of Rollers in the Course of Printing (1) The operator switches the manual instruction means 12 to "course (during)" position to send "course" instruction to the operation instruction means 11.

(2) The other switches are operated in the same way as in the above-described process (A). Then, the operation instruction means 10 carries out the steps (a)-(m) of the process (A) excluding steps (f), (g), (h), (i), (l), which are associated with the cleaning of the dampening water supply passage DT. Of course, the steps (a)-(m) are performed under sequential control.

The manual instruction means 12 may be equipped with a selector switch (not shown) to permit the operator to select either the right liquid supply rollers RS belonging to the right plate cylinder or the left liquid supply rollers LS belonging to the left plate cylinder or both sets of rollers.

The order in which the steps (a)-(m) are carried out can be modified unless the effects of the cleaning deteriorates. While the dampening water supply passage is being cleaned, neither the fountain rollers FR nor the brush rollers BR are operated.

Modifications may be made to allow even the surfaces of the blanket cylinders to be cleaned after the cleaning that is done subsequent to the end of a printing process. More specifically, at the end of the latter cleaning, the moving means (not shown) which is usually mounted in the offset press is activated to bring the blanket cylinders BC into contact with the press plates PC. A cleaning solvent is supplied to the surfaces of the blankets (not shown) on the blanket cylinders BC via the press plates on the plate cylinders PC. The wastes resulting from the cleaning is recovered by the rotating conduit 7. Alternatively, the wastes are directly removed from the surfaces of the blankets by printing paper (not shown). Preferably, the surfaces of the blankets are cleaned under sequential control of the operation instruction means 10 subsequent to a printing process after the ink supply passage IT is cleaned, independent of the cleaning of the dampening water supply passage DT, if possible.

While the invention has been particulary shown and described with reference to preferred embodiments thereof, it will be understood by those skilled in the art that various changes and variations may be made without departing from the spirit or scope of the appended claims.

As described in detail thus far, in accordance with the invention, the cleaning of a dampening water supply passage DT is not automated by itself. Rather, it is automated in association with automatic cleaning of the ink supply passage IT. Further, they are cleaned not simultaneously but in any desired order. In particular, the apparatus is so programmed that after the completion of the automatic cleaning of the ink supply passage IT, the dampening water supply passage DT is automatically cleaned as the need arises. Therefore, if the print quality deteriorates during printing, then only the ink supply passage can be cleaned in a conventional manner. When cleaning is done at the time of ink change or at the end of printing, all the ink left in the ink supply passage is removed. Then, automatic cleaning of the dampening water supply passage is initiated. For this reason, if the cleaning solvent is supplied into the dampening water supply passage from the ink supply source via the press plate on the plate cylinder, then the ink supply passage is not fouled with the wastes existing in the ink supply passage. Consequently, the passage can be cleaned satisfactorily. Since the wastes discharged from the dampening water supply passage go into the ink supply passage via the press plate on the plate cylinder and are recovered, the wastes are recovered certainly and in a short time. In the past, the worker who engaged in manual cleaning of the dampening water supply passage felt displeasure both physically and mentally. Hence, the invention relieves the worker of such displeasure. Where the surfaces of the blankets are cleaned after the end of printing blanket cleaning devices which have enjoyed wide acceptance can be omitted.

What is claim is:

1. An apparatus for automatically cleaning liquid supply rollers of an offset press having ink supply-stopping means, means for supplying a cleaning solvent into an ink supply passage, cleaning waste recovery means mounted in the ink supply passage means for bringing ink supply rollers adjacent to a plate cylinder into and out of contact with the plate cylinder, means for bringing dampening water supply rollers adjacent to the plate cylinder into and out of contact with the plate cylinder, and a main control means controlling the operation of the offset press, said apparatus comprising:

an operation instruction means which produces operation signals in a sequence to driving portions of said means which include the ink supply-stopping means, the means for supplying the cleaning solvent, the cleaning waste recovering means, the means for bringing the ink supply rollers out of contact with the plate cylinder, means for bringing the dampening water supply rollers out of contact with plate cylinder, and the main control means;

a start instruction means that starts the operation instruction means;

a manual instruction means which permits one to instruct the operation instruction means to clean only the ink supply passage or all of the ink supply passage and the dampening water supply passage, and, the ink supply passage in which a first ink cylinder is located on the most upstream side thereof, and the ink supply rollers adjacent to the plate on the plate cylinder are disposed on the most downstream side thereof.

2. A method of automatically cleaning liquid supply rollers of an offset press, in which cleaning of both an ink supply passage and a dampening water supply passage is achieved, comprising:

stopping the supply of ink, moving at least ink supply rollers adjacent to a plate cylinder away from the plate cylinder, and supplying a cleaning solvent into the ink supply passage to clean the passage, and pressing those ink supply rollers and dampening water supply rollers which are adjacent to the plate cylinder against the plate cylinder, supplying the cleaning solvent into the dampening water supply passage from the ink supply passage via a plate upon the plate cylinder, and recovering wastes from the ink supply passage via the plate upon the plate cylinder, the wastes arising from cleaning of the dampening water supply passage.

* * * * *

UNITED STATES PATENT AND TRADEMARK OFFICE

CERTIFICATE OF CORRECTION

PATENT NO. : 4,967,664

DATED : November 6, 1990

INVENTOR(S) : Takashi Iijima

It is certified that error appears in the above-identified patent and that said Letters Patent is hereby corrected as shown below:

Column 4, Line 46 "The pump IP" it should be — The ink pump IP —

Column 4, Line 50 "rail IT" it should be — rail IR —

Column 4, Line 53 " arm link " it should be — arm or link —

Column 5, Line 39 "also automatically " it should be — also be automatically —

Column 6, Line 63 " (l) "
it should be — (1) — the letter 1

Column 7, Line 9 "ther" it should be — the —

Signed and Sealed this

Eleventh Day of August, 1992

*Attest:*

*Attesting Officer*

DOUGLAS B. COMER

*Acting Commissioner of Patents and Trademarks*